US005720464A

United States Patent [19]

Meinscher et al.

[11] Patent Number: 5,720,464

[45] Date of Patent: Feb. 24, 1998

[54] COMBINATION PRESENTATION EASEL AND CARRYING CASE

[76] Inventors: Charles August Meinscher; June Lorene Parker, both of 13642 Wycliff Rise, San Antonio, Tex. 78231

[21] Appl. No.: 711,818

[22] Filed: Sep. 10, 1996

[51] Int. Cl.[6] ..... A47B 97/04

[52] U.S. Cl. ..... 248/447; 40/610; 248/461; 312/230

[58] Field of Search ..... 248/447, 451, 248/452, 453, 455, 457, 461; 312/230, 231; 108/14; 40/610

[56] References Cited

U.S. PATENT DOCUMENTS

| | | | |
|---|---|---|---|
| 2,538,318 | 1/1951 | Mitchell | 248/455 X |
| 2,981,030 | 4/1961 | Knop | 312/230 X |
| 3,952,989 | 4/1976 | Bannister Hatcher | 248/453 |
| 4,093,326 | 6/1978 | Ford | 312/231 |
| 4,978,096 | 12/1990 | Struckmann | 248/461 X |

*Primary Examiner*—Ramon O. Ramirez

[57] ABSTRACT

A combination presentation easel and carrying case for use in transporting and displaying items related to an audience presentation. The portable presentation easel consists of a two-part cover supported by extendable legs for the display of visual aids at a variety of heights, and for use with a white board or paper flipchart. The easel is equipped with storage compartments and attachments for any items related to the presentation. The easel may be folded in half and its legs retracted for easy transport. A hard outer covering protects the easel's contents. The easel is further equipped with a carrying handle, a display window for identification information, and security locks.

13 Claims, 2 Drawing Sheets

COMBINATION PRESENTATION EASEL AND CARRYING CASE

BACKGROUND OF THE INVENTION

1. Field of the Invention

The present invention relates to a unique presentation easel and carrying system for use in transporting and displaying items related to an audience presentation. The presentation easel provides a stand for the display of graphics, or for use with an erasable marking surface, such as a white board, or a large paper tablet. In addition, the easel is equipped with storage compartments for items such as handouts, business cards, and reference materials. It also has attachment capabilities for markers and an eraser. The easel may be folded in half and its tripod legs retracted for easy transport of its contents. When folded into its transportation configuration, the invention protects its contents with a hard, plastic covering. It further comprises a carrying handle, a display window for owner identification information, and a security locking mechanism. The transportation configuration has dimensions which permit it to be checked as a regular piece of luggage with most airlines.

2. Description of the Related Art

Various types of presentation and display easels are known in the art. Typically, they consist of a small shelf or tray located at the bottom of a generally rectangular backing. Items to be displayed rest on the shelf and lean against the backing. Alternatively, the backing may support a white board or a flipchart. In addition, it is common for such prior art presentation easels to be located on some type of stand for easier audience viewing of the items placed on the easel shelf. Typically, the stand consists of three legs: two which are parallel to and extend from the bottom of the backing and a third offsetting leg attached to the top rear of the backing and placed so that the easel will stand on its own. This third leg is typically adjustable so that the easel leans slightly to the rear such that display items placed on the shelf and resting against the backing will remain where positioned. These presentation easels may be placed on the floor (provided the legs are long enough) or may be placed on a table or podium, the idea being that presentation items placed on the easel can be readily viewed by an audience.

Prior art presentation easels tend to vary in the ways in which they extend to their full height for use. As described above, three legs in a tripod configuration are normally used to support the stand. These legs may be telescoping legs which allow the presentation easel to be adjustable in height. Other presentation easels use an outside frame that is generally U-shaped with two upward, parallel arms. When not in use, the backing and presentation materials rest between the two arms of the frame. When ready for use, the backing may be pulled up from the two arms of the frame which then serve as tracks for a separate frame which holds the backing. Once in its fully extended position, the backing frame is secured in place above the U-shaped frame in any of a number of ways, typically through the use of pop-out pins located on the U-shaped frame. The pins extend through holes in the two frames which align themselves when the easel is fully extended. Attached to the back of the backing frame is the third tripod leg which may be rearwardly extended and adjusted so that the presentation easel is stable.

Although quite functional and collapsible, the prior art presentation easels are not easily transportable. Because they typically do not have any type of outer covering, materials which are left attached to the presentation easel may become lost, rearranged, or damaged. If a large paper flipchart is attached to the backing, some of its pages may become torn or completely ripped off of the pad. Additionally, the repeated flipping of the paper chart pages up and over the top of the backing damages the pages. Further, the prior easels do not have any convenient means to keep related items such as white board pens or pointers together with the presentation easel; these must be separately carried and looked after. Finally, prior art presentation easels are typically limited in the type of presentation materials which they are designed to display. They usually house a pad of paper or a white board, or simply serve as a stand for graphics. Rarely do they serve more than one of these functions.

OBJECTS OF THE INVENTION

It is, therefore, an object of this invention to provide a portable presentation easel that enables easy transport of both its display items as well as related articles commonly used during a presentation.

It is another object of this invention to provide a presentation easel which is designed to protect its presentation materials and other related contents.

It is still another object of this invention to provide a presentation easel which is versatile and can be adapted to accommodate various types of presentation media.

It is yet another object of this invention to provide a presentation easel which is dependable, and easy to set up.

To achieve these and other objects which will become readily apparent upon a reading of the attached disclosure and appended claims, an improved portable presentation easel is provided. Additional objects, advantages, and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

According to the present invention, the foregoing and other objects and advantages are attained by an improved combination portable presentation easel and carrying case designed to display a variety of visual aids. The device generally comprises a hard outer carrying case which consists of two pieces, a top cover and a bottom cover, hinged together at one edge. Along an outer side edge of the bottom cover is attached a carrying handle. A display window for owner identification information is located on the outside of the cover. When the top and bottom covers are folded along the hinge so that they meet, they are held together by a security locking mechanism. Housed within the bottom cover and extending from the side opposite the hinge are two telescoping legs which are parallel to the plane of the bottom cover. A third telescoping, offsetting leg is pivotally attached to the outside of the bottom cover along its central axis. When the three legs are deployed in a tripod fashion regardless of whether the legs are extended, the presentation easel will stand on its own in either a high or low configuration. The top cover may then be opened upward along the hinge until it lies in the same plane as the bottom cover, thus exposing its display side. The strength of the materials used to form the legs, covers, framework, and hinge allows the top cover to remain upright once placed in that position. The exposed top cover display side may contain typical presentation media such as a white board, flip charts, a paper tablet, etc. In addition, the top cover contains multiple spaced rings protruding perpendicularly from the plane of the top cover which allow visual aids to be attached to the rings so that they may be easily leafed through while remaining in the proper order. Further, along the top edge of the top cover are a series of protruding pins to which visual aids may be attached and held in place. The bottom cover is equipped with a series of slightly protruding, variously sized pockets as well as attachment locations for needed items such as white board markers and a white board eraser.

The portable presentation easel thus reliably houses and transports visual presentation aids. In addition, the easel is easy to both set up and take down when making visual presentations.

Still other objects and advantages of the present invention will become readily apparent to those skilled in this art from the detailed description, wherein multiple preferred embodiments of the invention are shown and described, simply by way of illustration of the best mode contemplated by the inventor for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF THE PREFERRED EMBODIMENT

As generally described above, the device of the present invention has practical application in a number of situations. The portable device may be used to secure, carry, ship and store related presentation materials. The invention described may be used as an aid when making presentations to a variety of audience sizes. It allows the presenter to convey information with visual aids placed at the presenter's side while facing the audience. When the device is placed on the floor with its legs fully extended, the presenter can make his presentation while standing. Alternatively, the legs of the device may be deployed in a tripod configuration without being extended, thus allowing the device to be placed on a table or other stand for seated presentations. The device further allows the presenter to emphasize important points with a pointer or felt marker, and generally aids in making a lasting impression on the audience. Use of the presentation easel eliminates the need for slide or overhead projectors, screens, wires, outlets, other types of easels, white boards, or paper flip charts. Furthermore, storage and transportation of these items are facilitated by the device.

Figure 1:
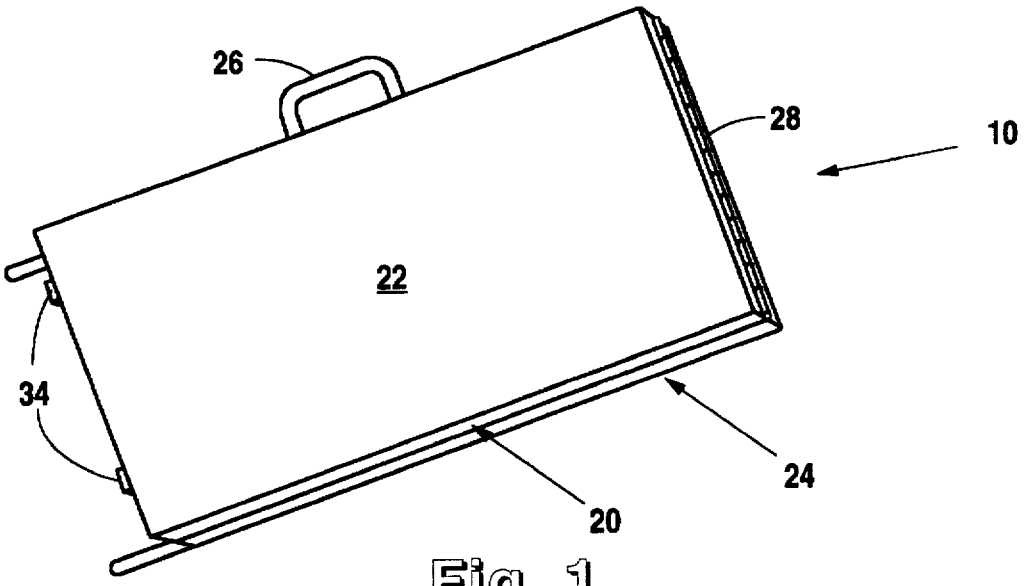
FIG. 1 is a perspective view of a preferred embodiment of the presentation easel device of the present invention.

Reference is made, therefore, to FIG. 1 for a description of a preferred embodiment of the current invention. FIG. 1 shows a combination portable presentation easel and carrying case (10) in its fully closed and locked position. The easel (10) includes a protective carrying case (20) made up of two, equal sized halves: a top cover (22) and a bottom cover (24). The carrying case (20) is constructed out of a high-strength, high-impact plastic and is typically precision molded. In the preferred embodiment, the carrying case (20) is rectangular in shape although it may have any other desired shape. A carrying handle (26) is attached to one edge of the bottom cover (24). The top cover (22) is connected to the bottom cover (24) along one edge of each cover by a plurality of hinges (28) which allow the top cover (22) to be rotated from a closed position parallel to and on top of the bottom cover (24) to an open position, also parallel to but in the same plane as the bottom cover (24). While a plurality of hinges (28) are used in the preferred embodiment, a single hinge or other pivotal connection may be used to connect the covers (22, 24).

Figure 2:
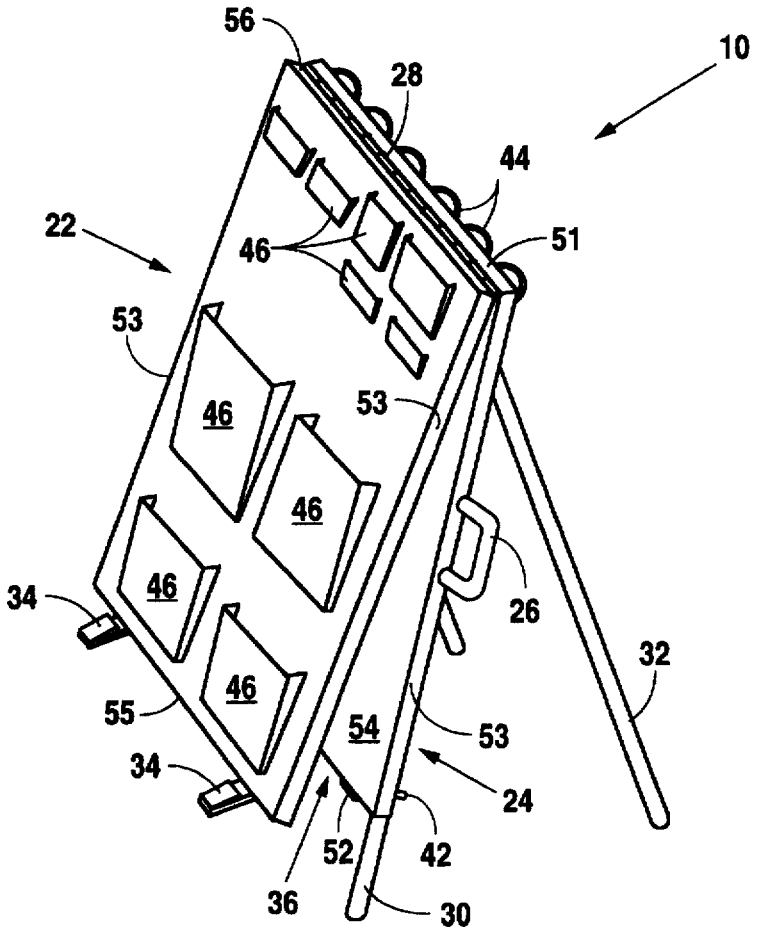
FIG. 2 is a perspective view of the presentation easel in a partially open position with the telescoping legs extended.

FIG. 2 depicts a perspective side view of the preferred embodiment of the portable presentation easel (10). The bottom cover (24) is shown visibly distinct from the top cover (22). The bottom cover (24) has a top edge (51), a bottom edge (52), and two side edges (53). The bottom cover (24) also has an interior side (54) and an exterior side (not shown). Similarly, the top cover (22) has a top edge (55) (viewed when the easel (10) is completely open for presentations), a bottom edge (56), two side edges (53), an interior side (not shown) and an exterior side (57). The preferred embodiment includes a flat support sheet (not shown), preferably made of aluminum, along the interior side of the top cover (22) to give the top cover (22) strength and support when the easel (10) is in its fully open position. FIG. 2 shows the easel (10) in a partially open position with its legs partially extended. In the preferred embodiment, the easel (10) has three telescoping legs: two forward, parallel legs (30) and one offsetting leg (32). In the preferred embodiment, the legs (30, 32) are made of square tubing, although the legs (30, 32) may have any cross-sectional shape. The bottom cover (24) is equipped to house all three legs (30, 32). The parallel legs (30) are housed in channels (not shown) which run vertically just inside the two side edges (53) of the bottom cover (24). The parallel legs (30) may be extended to any length when the easel (10) is being used to make presentations and are retractable within the channels when the easel (10) is being stored or transported. By varying the amount the legs (30, 32) are extended, the easel (10) may be placed on a variety of presentation settings, from the floor (legs fully extended) to a table top (legs fully retracted) and anywhere in between. Each leg (30, 32) is biased, preferably with an internal spring (not shown), to cause the leg to extend once released from any locked position.

The offsetting leg (32) attaches to the outside of the bottom cover (24) near the center of the top edge (51) of the bottom cover (24) closest to hinges (28). When not in use, the offsetting leg (32) snaps into a groove located down the middle of the exterior side (not shown) of the bottom cover (24). This aids in the transport and storage of the easel (10). Conversely, when the presentation easel (10) is being set up, the offsetting leg (32) is pivoted from its storage position to its support position so that the easel (10) will remain standing on its own. This is accomplished through a pivoting connection between the top of the offsetting leg (32) and the exterior side of the bottom cover (24).

The easel (10) is securely held closed through the use of a locking mechanism. In the preferred embodiment, the locking mechanism consists of clasp covers (34) attached along the top edge (55) of the top cover (22). When the easel (10) is closed, each clasp cover (34) may be flipped down to lockingly engage a corresponding clasp head (36) located on the bottom edge (52) of the bottom cover (24). The clasp covers (34) and clasp heads (36) are positioned so that when the carrying case (20) is closed, the clasp covers (34) and heads (36) align with one another. Other types of securing mechanisms may be used to hold the carrying case (20) closed, and additional security measures, such as combination locks, may be employed as needed.

Figure 3:
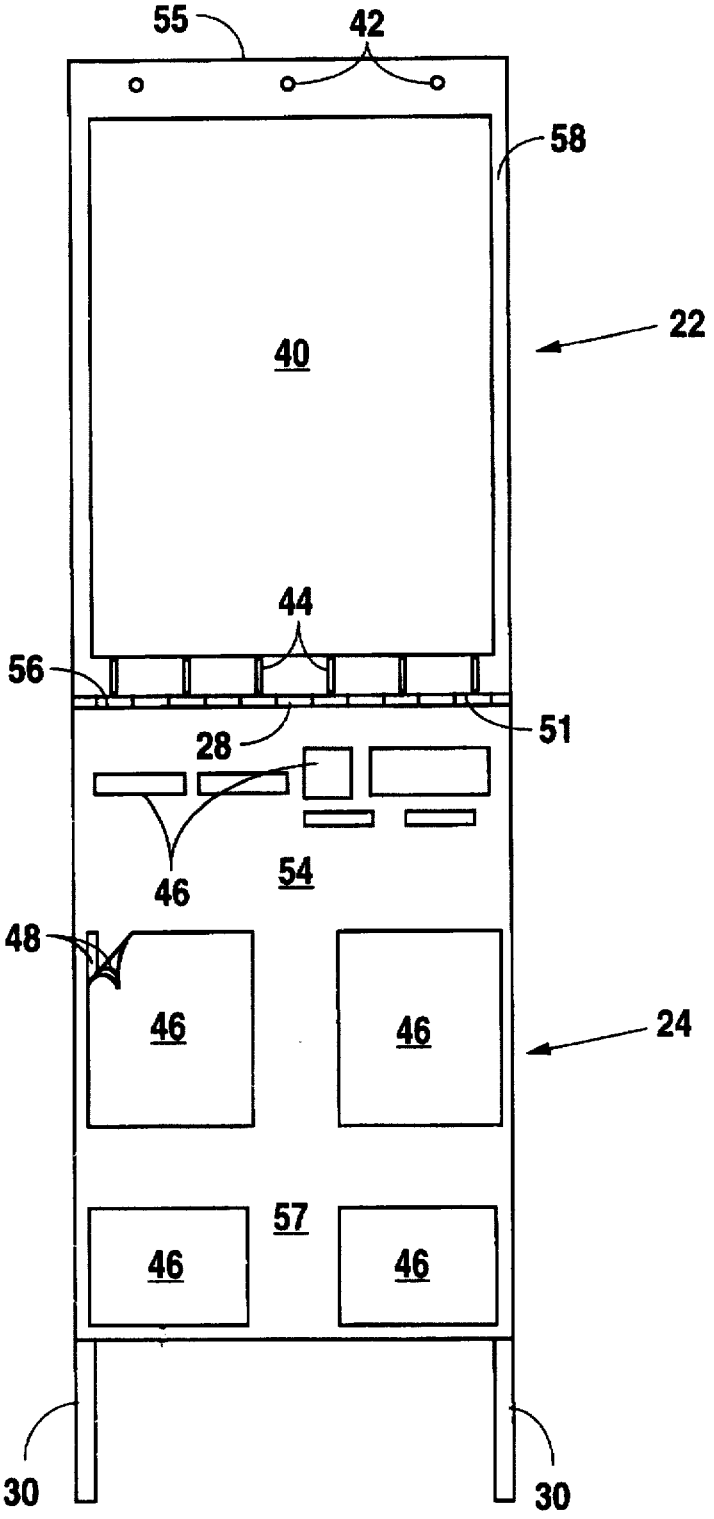
FIG. 3 is a front view of the presentation easel in a fully open position.

FIG. 3 depicts the combination easel and carrying case (10) in its fully open position for displaying presentations. The interior side (58) of the top cover (22) contains a full-sized white board (40). Alternatively, the top cover (22) may be designed to house a typical flip chart (not shown) mounted on its interior side (58). In the preferred embodiment, the interior side (58) of the top cover (22) contains a number of pins (42) arranged along the top edge (55), which protrude perpendicularly from the interior side (58) of the top cover (22). Along the bottom edge (56) of the inside of the top cover (22) are located a plurality of binder-like rings (44) which also protrude from the interior side (58) of the top cover (22). The rings (44) may be opened such that display graphics are placed on the rings (44) in the order needed for the presentation. The rings (44) are then closed. The display graphics are held in place for viewing by inserting the pins (42) through holes located in the top of each graphic. As the presentation proceeds, each exposed graphic may be released from the pins (42) and allowed to flip down about the rings (44) into the lower half of the carrying case (20) next to the bottom cover (24). In the preferred embodiment, approximately thirty pages of graphics may be stored on the pins (42) and rings (44). After the last graphic is flipped down in this fashion, the white board (40) is available for notes or discussion comments.

Once the presentation is complete, the top cover (22) may be folded down along the hinges (28) over the bottom cover (24) and secured thereto. The legs (30, 32) may then be retracted, making the combination portable presentation easel and carrying case (10) ready for transport. Not only does the interior side (54) of the bottom cover (24) serve as a resting place for graphics which have been flipped down, but it also houses various storage capabilities, such as various sized pockets (46). The pockets (46) are an integral part of the interior side (54) of the bottom cover (24). The pockets (46) may be used to store items to be distributed during the presentation, note pads, flyers, a calculator, a white board eraser, a pointer, extra business cards, and any other item which might be needed during the presentation. In the preferred embodiment, the interior side (54) of the bottom cover (24) is also equipped with a VELCRO fastener (48) to which additional items may be attached, such as white board markers and an eraser. When the combination presentation easel and carrying case (10) is closed and secured with its locking clasps (34, 36), the graphics or flip chart as well as any other items stored in the pockets (46) or with the fasteners (48) are securely locked inside the carrying case (20) for easy transportation. These contents are further protected by the outside surfaces of the top and bottom covers (22, 24).

It is intended that the above description of the preferred embodiment of the structure of the present invention is but one enabling best mode embodiment for implementing the invention. Variations in the above description likely to be conceived of by those skilled in the art still fall within the breadth and scope of the disclosure of the present invention. For example, the material from which the carrying case may be made has been described as a molded plastic; it could also be made from any of a number of materials, including various metals or even wood. Further, the specific contents which the easel is designed to present may be modified to aid in the presentation of other types of exhibits. The primary import of the present invention lies in its portability as well as its ability to protect its contents while remaining quick and easy to set up and take down. Its benefits derive from the versatility of application of the present invention and its low cost. Again, it is understood that other applications of the present invention will be apparent to those skilled in the art upon the reading of the preferred embodiments and a consideration of the appended claims and drawings.

What is claimed is:

1. A combination presentation easel and carrying case comprising:

a top cover having at least one edge;

a bottom cover having at least one edge;

a connection means for attachment of said top cover to said bottom cover;

at least two legs housed in said bottom cover;

an offsetting leg pivotally attached to said bottom cover;

at least one ring extending from said top cover, said ring allowing removable attachment of at least one display graphic such that said display graphic may be rotated about said ring for viewing;

at least one pin extending from said top cover, said pin providing a point of attachment for viewing said display graphic; and a carrying handle attached to said bottom cover.

2. The combination presentation easel and carrying case of claim 1, further comprising storage means for items used in conjunction with said easel.

3. The combination presentation easel and carrying case of claim 2, wherein said storage means is at least one pocket positioned on said bottom cover.

4. The combination presentation easel and carrying case of claim 2, wherein said storage means is at least one VELCRO fastener.

5. The combination presentation easel and carrying case of claim 1, further comprising a locking mechanism for securing said top cover to said bottom cover.

6. The combination presentation easel and carrying case of claim 1, wherein said connection means is at least one hinge attached to one of said edges of said top cover and of said bottom cover.

7. The combination presentation easel and carrying case of claim 1, wherein said top cover and said bottom cover have a generally rectangular shape.

8. The combination presentation easel and carrying case of claim 1, wherein said top cover houses an erasable writing surface.

9. The combination presentation easel and carrying case of claim 1, wherein said top cover houses a flip chart.

10. The combination presentation easel and carrying case of claim 1, wherein said legs are extendable.

11. The combination presentation easel and carrying case of claim 1, wherein said top cover includes a support sheet.

12. A combination presentation easel and carrying case for presenting display graphics comprising:

a top cover having a top edge, a bottom edge, two side edges, an interior side and an exterior side, said top cover having a generally rectangular shape;

a bottom cover having a top edge, a bottom edge, two side edges, an interior side and an exterior side, said bottom cover having a generally rectangular shape;

at least one hinge attached to said top edge of said bottom cover and to said bottom edge of said top cover;

a carrying handle attached to one of said edges of said bottom cover;

a pair of telescoping legs housed in said bottom cover and capable of being extended from said bottom edge of said bottom cover;

an offsetting leg pivotally attached to said exterior side of said bottom cover;

a locking mechanism for securing said top cover to said bottom cover in a closed position;

at least one pin extending from said interior side of said top cover adjacent said top edge of said top cover;

at least one ring extending from said interior side of said top cover adjacent said bottom edge of said top cover; and at least one pocket attached to said interior side of said bottom cover.

13. A combination presentation easel and carrying case for presenting display graphics comprising:

a top cover;

a bottom cover;

connecting means for hingedly attaching said top cover to said bottom cover;

securing means for holding said display graphics adjacent said top cover;

retain means capable of permitting said display graphics to be sequentially present and then flipped down adjacent to said bottom cover;

said connecting means is at least one hinge attached to an edge of said top cover and an edge of said bottom cover;

said securing means is at least one pin extending from said top cover opposite said connection means;

said retaining means is at least on e ring extending from said top cover adjacent said connection means;

a pair of legs housed in said bottom cover; and an offsetting leg pivotally attached adjacent said bottom cover.

* * * * *